US007041631B2

(12) United States Patent
Ochs et al.

(10) Patent No.: US 7,041,631 B2
(45) Date of Patent: May 9, 2006

(54) SURFACE-ACTIVE COMPOSITIONS COMPRISING A MIXTURE OF DIPHENYL ETHER AND O-PHENYL PHENO

(75) Inventors: Dietmar Ochs, Schopfheim (DE); François Brugger, Waltenheim (FR); Marcel Schnyder, Birsfelden (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/901,733

(22) Filed: Jul. 29, 2004

(65) Prior Publication Data

US 2005/0003994 A1 Jan. 6, 2005

Related U.S. Application Data

(63) Continuation of application No. 10/450,226, filed as application No. PCT/EP01/14356 on Dec. 6, 2001, now abandoned.

(30) Foreign Application Priority Data

Dec. 14, 2000 (EP) ..... 00811192

(51) Int. Cl.
*C11D 3/48* (2006.01)

(52) U.S. Cl. ..... 510/388; 510/382; 510/386; 510/387; 510/131

(58) Field of Classification Search ..... 510/382, 510/386, 387, 388, 131
See application file for complete search history.

(56) References Cited

U.S. PATENT DOCUMENTS

| | | | | | |
|---|---|---|---|---|---|
| 3,503,885 | A | | 3/1970 | Wedell | 252/105 |
| 3,917,850 | A | * | 11/1975 | Boucher | 514/705 |
| 5,772,640 | A | * | 6/1998 | Modak et al. | 604/265 |
| 5,955,408 | A | | 9/1999 | Kaiser et al. | 510/131 |
| 6,057,274 | A | * | 5/2000 | Bator | 510/130 |
| 6,066,606 | A | * | 5/2000 | Lu et al. | 510/101 |
| 6,106,851 | A | * | 8/2000 | Beerse et al. | 424/401 |
| 6,107,261 | A | | 8/2000 | Taylor et al. | 510/131 |
| 6,136,771 | A | | 10/2000 | Taylor et al. | 510/388 |
| 6,146,651 | A | * | 11/2000 | Kritzler | 424/404 |
| 6,159,916 | A | * | 12/2000 | Robbins et al. | 510/238 |
| 6,187,327 | B1 | * | 2/2001 | Stack | 424/405 |
| 6,365,563 | B1 | | 4/2002 | Hirsch et al. | 510/319 |
| 6,517,854 | B1 | * | 2/2003 | Stack | 424/405 |
| 6,531,434 | B1 | * | 3/2003 | Gluck | 510/131 |
| 6,616,922 | B1 | * | 9/2003 | Taylor et al. | 424/70.28 |
| 6,689,223 | B1 | * | 2/2004 | Meine et al. | 134/2 |

FOREIGN PATENT DOCUMENTS

| | | | |
|---|---|---|---|
| EP | 0855439 | | 7/1998 |
| EP | 0903401 | | 3/1999 |
| EP | 1167503 | | 1/2002 |
| WO | 96/06152 | | 2/1996 |
| WO | 98/55092 | | 12/1998 |
| WO | 00/13656 | * | 3/2000 |

* cited by examiner

*Primary Examiner*—Charles Boyer
(74) *Attorney, Agent, or Firm*—Kevin T. Mansfield

(57) ABSTRACT

A surface-active composition is described which comprises (a) from 0.01 to 90% by weight of a mixture of a microbicidal active ingredient of ($a_1$) a diphenyl ether compound and ($a_2$) a phenol derivative, (b) from 0 to 50% by weight of one or more hydrotropic agents, (c) from 0 to 80% by weight of one or more synthetic detergents or of a soap or of combinations of the mentioned substances and/or of a salt of a saturated and/or unsaturated $C_8$–$C_{22}$ fatty acid, (d) from 0 to 50% by weight of an alcohol, (e) from 0 to 50% by weight of typical ingredients for cleaning and disinfectant compositions and optionally (f) tap water or deionised water ad 100%.

The compositions are used for the antimicrobial treatment of human skin and hair, of hard surfaces and of textile fibre materials.

14 Claims, No Drawings

SURFACE-ACTIVE COMPOSITIONS COMPRISING A MIXTURE OF DIPHENYL ETHER AND O-PHENYL PHENO

This application is a continuation of Application No. 10/450,226, file Jun. 11, 2003 abandoned, which is the National Stage of International Application PCT/EP01/14356, filed Dec. 6, 2001.

The present invention relates to surface-active compositions and to the use of such compositions for the antimicrobial treatment of human skin and hair and for the treatment of hard surfaces and textile fibre materials.

Cleaning and disinfectant compositions comprising antimicrobial active ingredients, e.g. personal care preparations, hand and machine dishwashing formulations, cleaning and disinfecting formulations for hard surfaces and liquid and solid textile washing formulations, are becoming ever more widespread. Phenol derivatives and diphenyl ether compounds are known as antibacterial active ingredients.

It has now been found, surprisingly, that a combination of diphenyl ether compounds and phenol derivatives exhibits strong bactericidal effects.

The present invention accordingly relates to a surface-active composition comprising (a) from 0.01 to 90% by weight of a mixture of a microbicidal active ingredient of
  ($a_1$) a diphenyl ether compound and
  ($a_2$) a phenol derivative,
(b) from 0 to 50% by weight of one or more hydrotropic agents,
(c) from 0 to 80% by weight of one or more synthetic detergents or of a soap or of combinations of the mentioned substances and/or of a salt of a saturated and/or unsaturated $C_8$–$C_{22}$ fatty acid,
(d) from 0 to 50% by weight of an alcohol,
(e) from 0 to 50% by weight of typical ingredients for cleaning and disinfectant compositions and optionally
(f) tap water or deionised water ad 100%.

Preferably, the present invention accordingly relates to a surface-active composition comprising (a) from 0.01 to 10% by weight of a mixture of a microbicidal active ingredient of
  ($a_1$) a diphenyl ether compound and
  ($a_2$) a phenol derivative,
(b) from 0 to 50% by weight of one or more hydrotropic agents,
(c) from 5 to 80% by weight of one or more synthetic detergents or of a soap or of combinations of the mentioned substances and/or of a salt of a saturated and/or unsaturated $C_8$–$C_{22}$ fatty acid,
(d) from 0 to 50% by weight of an alcohol, and optionally
(f) tap water or deionised water ad 100%.

The composition according to the invention preferably comprises as component ($a_1$) a hydroxy-diphenyl ether of formula

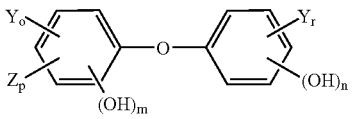

(1a) wherein

Y is chlorine or bromine,

Z is $SO_2H$, $NO_2$ or $C_1$–$C_4$alkyl, r is from 0 to 3, o is from 0 to 3, p is 0, 1 or 2, m is 1 or 2 and n is 0 or 1, and more especially a compound of

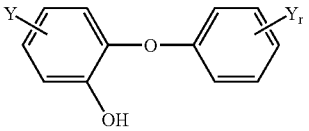

(1b) wherein

Y is chlorine and r is 1 or 2.

Very special preference is given to a compound of formula

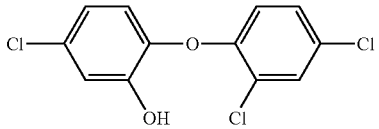

(2) or

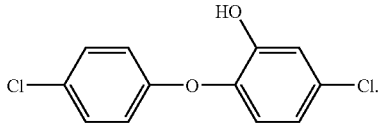

(3)

As component ($a_1$) there can also be used a non-halogenated hydroxydiphenyl ether of formula

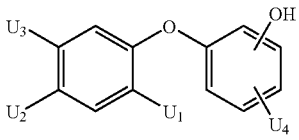

(1′) wherein $U_1$ and $U_2$ are each independently of the other hydrogen, hydroxy, unsubstituted or hydroxy-substituted $C_1$–$C_{20}$alkyl, $C_5$–$C_7$cycloalkyl, $C_1$–$C_6$alkylcarbonyl, $C_1$–$C_{20}$alkoxy, phenyl or phenyl-$C_1$–$C_3$alkyl;

$U_3$ is hydrogen, $C_1$–$C_{20}$alkyl, $C_1$–$C_{20}$alkoxy or $C_1$–$C_6$alkylcarbonyl; and $U_4$ is hydrogen, unsubstituted or hydroxy-substituted $C_1$–$C_{20}$alkyl, $C_5$–$C_7$cycloalkyl, hydroxy, formyl, acetonyl, $C_1$–$C_6$alkylcarbonyl, $C_2$–$C_{20}$alkenyl, carboxy, carboxy-$C_1$–$C_3$alkyl, $C_1$–$C_3$alkylcarbonyl-$C_1$–$C_3$alkyl or carboxyallyl.

$U_1$, $U_2$, $U_3$ and $U_4$ having the meaning of $C_1$–$C_{20}$alkyl are straight-chain or branched alkyl radicals, for example methyl, ethyl, n-propyl, isopropyl, n-butyl, sec-butyl, tert-butyl, pentyl, isopentyl, tert-pentyl, hexyl, cyclohexyl, heptyl, octyl, isooctyl, nonyl, decyl and the like.

$U_1$, $U_2$ and $U_3$ as $C_1$–$C_{20}$alkoxy are straight-chain or branched alkoxy radicals, for example methoxy, ethoxy, n-propoxy, isopropoxy, n-butoxy, sec-butoxy, tert-butoxy, pentyloxy, iso-pentyloxy, tert-pentyloxy, heptyloxy, octyloxy, isooctyloxy, nonyloxy, decyloxy and the like.

$U_1$, $U_2$, $U_3$ and $U_4$ having the meaning of $C_1$–$C_6$alkylcarbonyl are straight-chain or branched carbonyl radicals, for example acetyl, propionyl, butyryl, isobutyryl, valeryl, isovaleryl, pivaloyl and the like.

$U_1$, $U_2$ and $U_4$ having the meaning of hydroxy-substituted $C_1$–$C_{20}$alkyl are, for example, hydroxymethyl, hydroxyethyl, hydroxypropyl, hydroxybutyl, hydroxypentyl, hydroxyhexyl, hydroxyheptyl, hydroxyoctyl, hydroxynonyl, hydroxydecyl and the like.

According to the invention, preference is given to the use of compounds of formula (1') wherein OH is in the meta- or para-position relative to the ether bond.

Preferably, $U_1$ and $U_2$ are each independently of the other hydrogen, $C_1$–$C_{20}$alkyl, $C_1$–$C_6$alkylcarbonyl or $C_1$–$C_{20}$alkoxy.

$U_3$ is preferably hydrogen, $C_1$–$C_{20}$alkyl or $C_1$–$C_{20}$alkoxy.

$U_4$ is preferably hydrogen, $C_1$–$C_{20}$alkyl, hydroxy, formyl, acetonyl, allyl, carboxymethyl, carboxyallyl, hydroxy-substituted $C_1$–$C_{20}$alkyl or $C_1$–$C_6$alkylcarbonyl.

Compounds of formula (1') that are of special interest are:

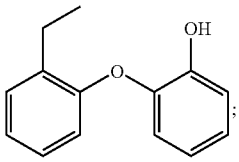

;

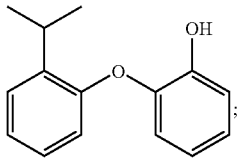

;

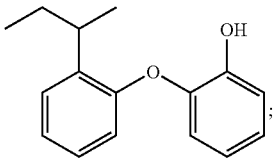

;

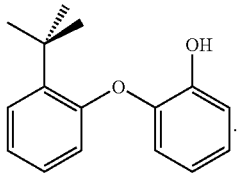

.

Other compounds of formula (1') that are of special interest are:

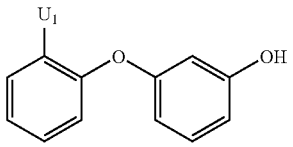

wherein $U_1$ is $C_1$–$C_5$alkyl, for example the compound of formula

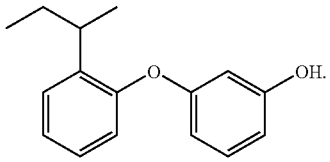

Also of interest are compounds of formula

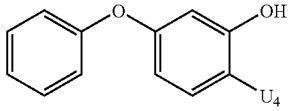

wherein $U_4$ is $C_1$–$C_5$alkyl, for example the compound of formula

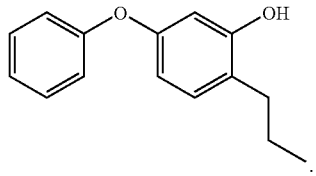

.

The following compounds are of special interest:

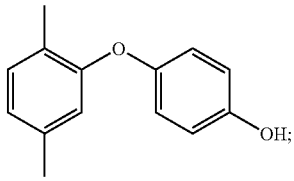

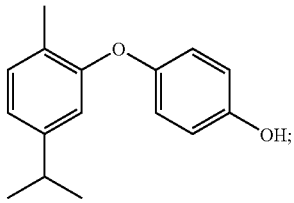

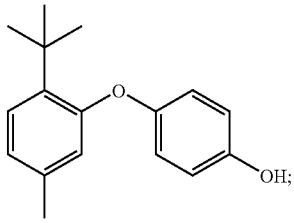

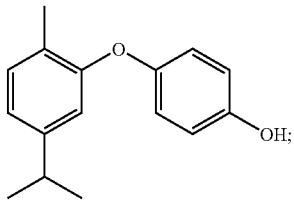

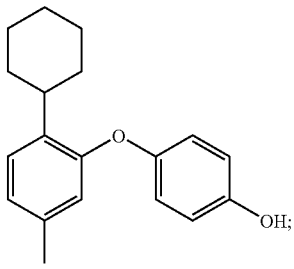

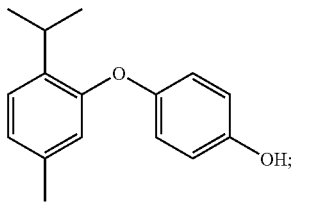

or

-continued

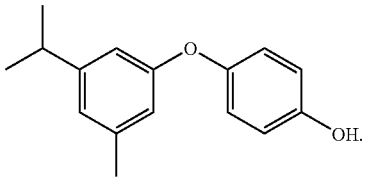

The compounds of formula (1') are known or can be prepared using methods analogous to those known.

Compounds suitable as component ($a_2$) are preferably those selected from phenol derivatives of formula

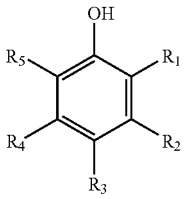

(4)

wherein $R_1$ is hydrogen, hydroxy, $C_1$–$C_{20}$alkyl, chloro, phenyl, benzyl or nitro, $R_2$ is hydrogen, hydroxy, $C_1$–$C_{20}$alkyl or halogen, $R_3$ is hydrogen, $C_1$–$C_{20}$alkyl, hydroxy or chloro, $R_4$ is hydrogen or methyl, and $R_5$ is hydrogen or nitro.

Exemplary compounds are chlorophenols (o-, m-, p-chlorophenols), 2,4-dichlorophenol, p-nitrophenol, xylenol, p-chloro-m-xylenol, cresols (o-, m-, p-cresols), p-chloro-m-cresol, pyrocatechol, resorcinol, orcinol, 4-n-hexylresorcinol, pyrogallol, phloroglucinol, carvacrol, thymol, p-chlorothymol, o-phenylphenol, o-benzylphenol and p-chloro-o-benzylphenol.

Further exemplary representatives of component ($a_2$) are chlorhexidines, for example 1,1'-hexamethylene-bis(5-(p-chlorophenyl)biguanide), together with organic and inorganic acids and chlorhexidine derivatives, such as their diacetates, digluconates or dihydrochloride compounds.

Further exemplary phenol derivatives are 1-phenoxypropan-2-ol and 3-(4-chlorophenoxy)-1,2-propanediol.

Very special preference is given to the use of o-phenylphenol as component ($a_2$).

In the composition according to the invention, the combination of ($a_1$) the compound of formula (2) or (3) and ($a_2$) o-phenylphenol is especially used.

The following compounds are suitable as component (b):

sulfonates of terpenoids, or of mono- or di-nuclear aromatic compounds, for example sulfonates of camphor, toluene, xylene, cumene or of naphthol;

saturated or unsaturated $C_3$–$C_{12}$ di- or poly-carboxylic acids, for example malonic, succinic, glutaric, adipic, pimelic, suberic, azelaic and sebacic acid, undecane- and dodecane-dioic acid, fumaric, maleic, tartaric and malic acid, and citric and aconitic acid;

aminocarboxylic acids, such as ethylenediaminetetraacetic acid, hydroxyethylethylenediaminetetraacetic acid and nitrilotriacetic acid;

cycloaliphatic carboxylic acids, such as camphoric acid;

aromatic carboxylic acids, such as benzoic, phenylacetic, phenoxyacetic and cinnamic acid, 2-, 3- and 4-hydroxybenzoic acid, anilic acid, and o-, m- and p-chlorophenylacetic acid and o-, m- and p-chlorophenoxyacetic acid;

isethionic acid;

tannic acid;

acid amides of formula

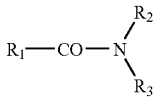

wherein $R_1$ is hydrogen or $C_1$–$C_{12}$alkyl and $R_2$ and $R_3$ are each independently of the other hydrogen, $C_1$–$C_{12}$alkyl, $C_2$–$C_{12}$alkenyl, $C_2$–$C_{12}$hydroxyalkenyl, $C_2$–$C_{12}$hydroxyalkyl or a polyglycol ether chain having from 1 to 30 —$CH_2$—$CH_2$—O— or —$CHY_1$—$CHY_2$—O— groupings, wherein one of the radicals $Y_1$ and $Y_2$ is hydrogen and the other is methyl, such as N-methylacetamide;

urea derivatives of formula

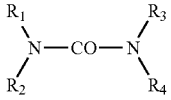

wherein $R_1$, $R_2$, $R_3$ and $R_4$ are each independently of the others hydrogen, $C_1$–$C_8$alkyl, $C_2$–$C_8$alkenyl, $C_1$–$C_8$hydroxyalkyl or $C_2$–$C_8$hydroxyalkenyl.

All the organic acids mentioned under (b) can also be in the form of their water-soluble salts, such as the alkali metal salts, especially the sodium or potassium salts, or the amine ($NR_1R_2R_3$) salts wherein $R_1$, $R_2$ and $R_3$ are each independently of the others hydrogen, $C_1$–$C_8$alkyl, $C_2$–$C_8$alkenyl, $C_1$–$C_8$-hydroxyalkyl, $C_5$–$C_8$cycloalkyl or polyalkyleneoxy-$C_1$–$C_{18}$alkyl or $R_1$, $R_2$ and $R_3$, together with the nitrogen atom to which they are bonded, are unsubstituted or $C_1$–$C_4$alkyl-substituted morpholino.

Component (b) can consist of a single compound or a plurality of different compounds.

Very special preference is given to a combination of cumenesulfonate and citric acid monohydrate.

As component (c), anionic, nonionic, or zwitterionic and amphoteric synthetic detergents are suitable.

Suitable anionic detergents are sulfates, for example fatty alcohol sulfates, the alkyl chain of which has from 8 to 18 carbon atoms, for example sulfated lauryl alcohol;

fatty alcohol ether sulfates, for example the acid esters or salts thereof of a polyaddition product of from 2 to 30 mol of ethylene oxide and 1 mol of a $C_8$–$C_{22}$ fatty alcohol;

the alkali metal, ammonium or amine salts, referred to as soaps, of $C_8$–$C_{20}$ fatty acids, for example coconut fatty acid;

alkylamide sulfates;

alkylamine sulfates, for example monoethanolamine lauryl sulfate;

alkylamide ether sulfates;
alkylaryl polyether sulfates;
monoglyceride sulfates;
alkanesulfonates, the alkyl chain of which contains from 8 to 20 carbon atoms, for example dodecyl sulfonate;
alkylamide sulfonates;
alkylaryl sulfonates;
α-olefin sulfonates;
sulfosuccinic acid derivatives, for example alkyl sulfosuccinates, alkyl ether sulfosuccinates or alkylsulfosuccinamide derivatives;
N-[alkylamidoalkyl]amino acids of formula

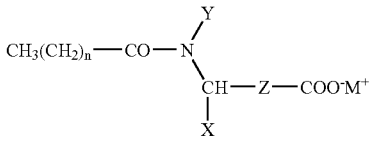

wherein
X is hydrogen, $C_1$–$C_4$alkyl or —$COO^-M^+$,
Y is hydrogen or $C_1$–$C_4$alkyl, —$(CH_2)$—$_{m_1}$–1
Z is
$m_1$ is from 1 to 5,
$n_1$ is an integer from 6 to 18 and
M is an alkali metal cation or amine cation,
alkyl and alkylaryl ether carboxylates of formula (13) $CH_3$—X—Y-A wherein
X is a radical of formula —$(CH_2)_{5-19}$—O—,

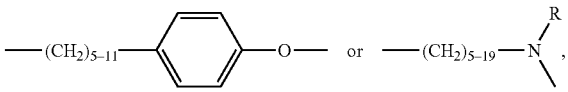

R is hydrogen or $C_1$–$C_4$alkyl,
Y is —$(CHCHO)_{1-50}$—,
A is $(CH_2)_{m2-1}$—$COO^-M^+$ or

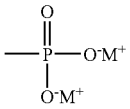

$m_2$ is from 1 to 6 and
M is an alkali metal cation or amine cation.

Also used as anionic surfactants are fatty acid methyl taurides, alkyl isothionates, fatty acid polypeptide condensation products and fatty alcohol phosphoric acid esters. The alkyl radicals occurring in those compounds preferably have from 8 to 24 carbon atoms.

The anionic surfactants are generally in the form of their water-soluble salts, such as the alkali metal, ammonium or amine salts. Examples of such salts include lithium, sodium, potassium, ammonium, triethylamine, ethanolamine, diethanolamine and triethanolamine salts. The sodium, potassium or ammonium ($NR_1R_2R_3$) salts, especially, are used, with $R_1$, $R_2$ and $R_3$ each independently of the others being hydrogen, $C_1$–$C_4$alkyl or $C_1$–$C_4$hydroxyalkyl.

Especially preferred anionic surfactants in the composition according to the invention are monoethanolamine lauryl sulfate or the alkali metal salts of fatty alcohol sulfates, especially sodium lauryl sulfate and the reaction product of from 2 to 4 mol of ethylene oxide and sodium lauryl ether sulfate.

Suitable zwitterionic and amphoteric surfactants include $C_8$–$C_{18}$betaines, $C_8$–$C_{18}$sulfobetaines, $C_8$–$C_{24}$alkylamido-$C_1$–$C_4$alkylenebetaines, imidazoline carboxylates, alkylamphocarboxycarboxylic acids, alkylamphocarboxylic acids (e.g. lauroamphoglycinate) and N-alkyl-β-aminopropionates or -iminodipropionates, with preference being given to $C_{10}$–$C_{20}$alkylamido-$C_1$–$C_4$akylenebetaines and especially to coconut fatty acid amide propylbetaine.

Nonionic surfactants that may be mentioned include, for example, derivatives of the adducts of propylene oxide/ethylene oxide having a molecular weight of from 1000 to 15 000, fatty alcohol ethoxylates (1–50 EO), alkylphenol polyglycol ethers (1–50 EO), polyglucosides, ethoxylated hydrocarbons, fatty acid glycol partial esters, for example diethylene glycol monostearate, fatty acid alkanolamides and dialkanolamides, fatty acid alkanolamide ethoxylates and fatty amine oxides.

As component (c) there may also be used the salts of saturated and unsaturated $C_8$–$C_{22}$ fatty acids either alone or in the form of a mixture with one another or in the form of a mixture with other detergents mentioned as component (c). Examples of such fatty acids include, for example, capric, lauric, myristic, palmitic, stearic, arachidic, behenic, caproleic, dodecenoic, tetradecenoic, octadecenoic, oleic, eicosenoic and erucic acid, and the commercial mixtures of such acids, such as, for example, coconut fatty acid. Such acids are present in the form of salts, there coming into consideration as cations alkali metal cations, such as sodium and potassium cations, metal atoms, such as zinc and aluminium atoms, and nitrogen-containing organic compounds of sufficient alkalinity, such as amines and ethoxylated amines. Such salts may also be prepared in situ.

As component (d) there come into consideration as dihydric alcohols especially those compounds having from 2 to 6 carbon atoms in the alkylene moiety, such as ethylene glycol, 1,2- or 1,3-propanediol, 1,3-, 1,4- or 2,3-butanediol, 1,5-pentanediol and 1,6-hexanediol.

Preference is given to 1,2-propanediol (propylene glycol).

Preferred monohydric alcohols are ethanol, n-propanol and isopropanol and mixtures of those alcohols.

The composition according to the invention comprises, as component (e), builders (zeolites/layered silicates), bleaching agents or bleaching systems (perborate/percarbonate plus TAED), fluorescent whitening agents and enzymes.

Furthermore, the washing composition can comprise enzymes, enzyme stabilisers, thickeners, sequestering agents, for example EDTA or phosphoric acid salts, corrosion inhibitors, colourants, perfumes, fluorescent whitening agents, buffer compounds or the like.

Compositions according to the invention can be prepared by mixing components (a) and optionally (b), (c), (d) and (e) in any desired order with the requisite amount of deionised water and stirring the batch until homogeneous. The composition is made up to 100% with tap water or deionised water. The procedure is purely physical. No chemical reaction takes place between the individual components.

Cleaning and disinfecting formulations according to the present invention may further comprise thickening agents, sequestering agents, antioxidants, UV absorbers, dyes, perfumes, buffer compounds, vitamins, moisturizers, body care substances, solids like waxes etc.

The formulations according to the invention exhibit strong bactericidal activity in two respects:

rapid destruction of germs present.

This can be demonstrated, for example, by a suspension test, e.g. according to test method EN 1276.

long-term bactericidal activity on the treated surface, as a result of which recolonisation is prevented effectively.

This can be demonstrated, for example, by the AATCC 100-1993 method.

They are therefore suitable for disinfecting and cleaning human skin and hands, hard articles and textile fibre materials and can be applied thereto in dilute or undiluted form, an amount of at least 2 ml, preferably in the undiluted form, being suitable for disinfection of the hands.

The compositions according to the invention are very especially used in washing and cleaning formulations, for example in household washing formulations, powder washing formulations, washing pastes, fabric softeners, solid soaps, dishwashing formulations, all-purpose cleaners, especially in liquid washing formulations for textile fibre materials.

The invention accordingly relates also to a method for the antimicrobial treatment of textile fibre materials in washing liquor, which method comprises treating the textile fibre materials in the washing liquor with a composition comprising (a) a microbicidal active ingredient of ($a_1$) from 0 to 5% by weight of a diphenyl ether compound and ($a_2$) from 0.1 to 5% by weight of a phenol derivative, (b) from 0 to 50% by weight of one or more hydrotropic agents, (c) from 5 to 80% by weight of one or more synthetic detergents or of a soap or of combinations of the mentioned substances and/or of a salt of a saturated and/or unsaturated $C_8$–$C_{22}$ fatty acid, (f) from 0 to 50% by weight of an alcohol, and optionally (e) from 0 to 50% by weight of typical ingredients for cleaning and disinfectant compositions and optionally (f) tap water or deionised water ad 100%.

In the method according to the invention preference is given to a washing liquor that is free of diphenyl ether compounds, that is to say contains no component ($a_1$).

The invention relates also to a method for imparting antimicrobial properties to textile fibre materials, which method comprises treating the textile fibre materials in the washing liquor with a composition comprising (a) from 0.01 to 10% by weight of a mixture of a microbicidal active ingredient of ($a_1$) a diphenyl ether compound and ($a_2$) a phenol derivative, (b) from 0 to 50% by weight of one or more hydrotropic agents, (c) from 5 to 80% by weight of one or more synthetic detergents or of a soap or of combinations of the mentioned substances and/or of a salt of a saturated and/or unsaturated $C_8$–$C_{22}$ fatty acid, (g) from 0 to 50% by weight of an alcohol, (h) from 0 to 50% by weight of typical ingredients for cleaning and disinfectant compositions and optionally and optionally (i) tap water or deionised water ad 100%, at least a fraction of the antimicrobial active ingredient remaining on the textile fibre material.

The textile materials that can be treated in accordance with the invention are undyed or dyed or printed, natural or synthetic fibre materials, for example of silk, wool, polyamide or polyurethanes, and especially cellulosic fibre materials of all kinds. Such fibre materials are, for example, natural cellulose fibres, such as cotton, linen, jute and hemp, as well as cellulose and regenerated cellulose. Preferred suitable textile fibre materials are of cotton.

Using the composition according to the invention it is possible to destroy bacteria present on the washing material in the dilute liquor during the washing procedure. At the same time, antimicrobial properties are imparted to the washed textile material, that is to say bacteria that get on the textile material while it is being worn are destroyed.

The following Examples illustrate the invention. Percentages and parts are percentages by weight and parts by weight, respectively.

EXAMPLES 1

Preparation of a Liquid Washing Formulations (1)–(5)

Liquid formulations having the following compositions are prepared:

| | Formulation | | | | |
|---|---|---|---|---|---|
| | 1 | 2 | 3 | 4 | 5 |
| combination of 30% of the compound of formula (3) and 70% of propylene glycol | 0.6 | 0.6 | 0.6 | — | — |
| o-phenylphenol | 0.5 | 1 | 1 | 1 | 2 |
| sodium dodecylbenzenesulfonate | 6 | 6 | 6 | 6 | 6 |
| sodium lauryl sulfate | 8 | 8 | 8 | 8 | 8 |
| Pareth 45-7 (Dobanol 45-7) | 4 | 4 | 4 | 4 | 4 |
| ethanol | 9 | 9 | 9 | 9 | 9 |
| sodium cumenesulfonate | 5 | — | 5 | 5 | — |
| soap noodles (Mettler) | 5 | 7 | 7 | 5 | 7 |
| trisodium citrate dihydrate | 2 | 2 | 2 | 2 | 2 |
| triethanolamine | 5 | 5 | 5 | 5 | 5 |
| fluorescent whitening agents | 0.3 | 0.3 | 0.3 | 0.3 | 0.3 |
| water to | 100 | 100 | 100 | 100 | 100 |

EXAMPLE 2

Determination of the Bactericidal Efficacy of Formulations (1) to (5) in Accordance with EN 1276 (Concentration 80%, contact Time 5 Minutes) in Log Reduction Test Principle:

1.0 ml of a bacterial suspension is added to 8.0 ml of the formulation in question (the test concentration is multiplied by a factor of 1.25) and to 1.0 ml of a suspension of 0.3% (factor 10) bovine albumin and mixed vigorously. After the contact time (see above) at 21° C. (+/−1° C.), a 0.1 ml sample is removed and added to 50 ml of TSB+inactivator (=test neutralisation mixture, $10^0$). 500 μl of the neutralisation mixture are added to 9 ml of TSB+inactivator to give a $10^{-2}$ dilution. Each test neutralisation mixture and the dilutions are filtered over a membrane and washed with 150 ml of distilled water. The membranes are incubated for 48 hours on the surface of agar plates. After incubation, the colonies are counted and listed in a Table, and the log reduction is calculated.

The results are given in Table 1.

TABLE 1

| | Formulation | | | | |
|---|---|---|---|---|---|
| | 1 | 2 | 3 | 4 | 5 |
| S.a. ATCC 6538 | >5 | >5 | 4.6 | 4.5 | >5 |
| E.c. ATCC 10536 | >5 | >5 | 4.5 | 3.8 | >5 |
| E.h. ATCC 10541 | >5 | >5 | >5 | >5 | >5 |
| Ps.a. ATCC 15442 | 3 | 4.3 | 4 | 3.9 | >5 |

The results in Table 1 show that good bactericidal effects can be achieved on the textile material using the formulations according to the invention.

EXAMPLE 3

Determination of the Bactericidal Effects, During Wear (from 0 to 24 hours), on Textile Material Washed Under Standard Conditions

| | |
|---|---|
| Textile material: | cotton |
| washing formulation: | 2.3 g |
| water: | 300 ml |
| liquor ratio: | 1:10 |
| duration of treatment: | 10 min |
| temperature: | 40° C. |

Test Principle:

Round cotton textile patches which have been washed under standard conditions (2.3 g detergent in a 300 ml liquor; 30 g textile; washing period: 10 minutes at 40° C.) are placed in sterile Petri dishes (diameter: 55 mm).

All the samples are then inoculated with 0.25 ml of a bacterial suspension (approx. ~$10^5$ cfu/sample) and placed in a humidity chamber at 37° C.

Directly after inoculation and after 8 and 24 hours at 37° C., the inoculated textile patches are placed in 50 ml of 0.07 molar phosphate buffer (pH 7.4, containing 1% Tween 80 and 0.3% lecithin) and shaken for 1 minute. After shaking, a dilution series in sterile distilled water, down to a concentration of $10^{-2}$, is prepared. 100 μl samples of the undiluted solution and of the $10^{-1}$ and $10^{-2}$ dilutions are applied to the plates using a spiralometer. After incubation, the surviving colonies are counted, calculated as cfu/sample and given in Table 2 herein below.

| | Formulation of the detergents | | |
|---|---|---|---|
| | 6 | 7 | 8 |
| combination of 30% of the compound of formula (3) and 70% of propylene glycol | — | — | 0.6 |
| o-phenylphenol | — | 2 | 0.5 |
| sodium dodecylbenzenesulfonate | 20 | 20 | 20 |
| Pareth 45-7 (Dobanol 45-7) | 14 | 14 | 14 |
| ethanol | 9 | 9 | 9 |
| soap noodles (Mettler) | 10 | 10 | 10 |
| trisodium citrate dihydrate | 4 | 4 | 4 |
| triethanolamine | 5 | 5 | 5 |
| water | ad 100% | ad 100% | ad 100% |
| pH "as is" | 10.5 | 10.3 | 10.3 |
| appearance | clear, yellowish | clear, yellowish | clear, yellowish |

TABLE 2

AATCC 100-1993 cotton washed with a washing formulation under standard conditions (2.3 g of det./300 ml of water/washing liquor 1:10, 10 min., 40° C.)

| | | Formulation | | |
|---|---|---|---|---|
| | | 6 | 7 | 8 |
| *S. aureus* ATCC 6538 | 0 h | $4.4 \times 10^5$ | | |
| | | | $3.6 \times 10^5$ | $4.1 \times 10^5$ |
| | 8 h | | $3.9 \times 10^5$ | |
| | | $8.2 \times 10^5$ | | |
| | 24 h | $1.0 \times 10^7$ | $4.1 \times 10^5$ | <100 |
| *Klebsiella pneumoniae* ATCC 4352 | 0 h | $1.9 \times 10^5$ | | |
| | | | $1.8 \times 10^5$ | $1.8 \times 10^5$ |
| | 8 h | $5.7 \times 10^8$ | $4.3 \times 10^8$ | $3.1 \times 10^2$ |
| | | | | $1 \times 10^2$ |
| | 24 h | $2.7 \times 10^9$ | $1.6 \times 10^9$ | <100 |

Only detergent compositions comprising the compound of formula (3) show a distinct antimicrobial activity on the textile material.

EXAMPLE 4

Preparation of Further Liquid Washing Formulations

| | Formulation | | | | | | | | | | |
|---|---|---|---|---|---|---|---|---|---|---|---|
| Components | 9 | 10 | 11 | 12 | 13 | 14 | 15 | 16 | 17 | 18 | 19 |
| combination of 30% of the compound of formula (3) and 70% of propylene glycol | 0.6 | 0.6 | 0.6 | 0.6 | 0.6 | 0.6 | 0.6 | 0.6 | 0.6 | 0.6 | 0.6 |
| o-phenylphenol | 0.9 | 0.9 | 0.9 | 0.9 | 0.9 | 0.9 | 0.9 | 0.9 | 0.9 | 0.9 | 0.9 |
| dodecylbenzenesulfonic acid | 7.5 | | | | | | | 8.5 | | | |
| sodium dodecylbenzenesulfonate | | 27 | 23.6 | 10 | 28 | | | | 20 | 24 | 6 |
| sodium laureth sulfate 3 EO | 17 | 10 | | | | | | | | | |

-continued

| Components | Formulation 9 | 10 | 11 | 12 | 13 | 14 | 15 | 16 | 17 | 18 | 19 |
|---|---|---|---|---|---|---|---|---|---|---|---|
| sodium lauryl sulfate | | | | | | 6 | | | | | 8 |
| coconut acid | 12.5 | | | 10 | 4 | 4 | 10 | | | 10 | |
| $C_{12-13}$ Pareth-7 | 10 | | | | | | | 26.9 | 27.8 | 25 | 4 |
| PEG-7 $C_{13}$ oxoalcohol | | | | 20 | 9 | 14.5 | 12 | 29 | 26 | | |
| PEG-8 $C_{13-15}$ fatty alcohol | | | | | | | 10 | | | | |
| alkyl polyglucoside | | | 5 | | | 1 | 2 | | | | |
| laureth-10 | | 5 | | | | | | | | | |
| PPG | | | | 2 | 3 | 8 | | | | | |
| sodium carbonate | | | 2 | | | | | | | | |
| sodium tripolyphosphate | | | 20 | | | | | | | | |
| potassium tripolyphosphate 50% | | 22 | | | | | | | | | |
| sodium cumenesulfonate 40% | | 25 | | | | | | | | | |
| trisodium citrate | 5.5 | | | | | 2 | | | | | 2 |
| lauryltrimonium chloride | 0.7 | | | | | | | | | | |
| polycarboxylate | | | | 13 | 18 | 15 | 10 | 23 | 16.2 | | |
| 2-propanol | 6 | | | 7 | 3 | | 4 | 9.5 | 8 | | |
| ethanol | 6 | | | | | | | | | | 9 |
| glycerol | | | | | | | | | | 20 | |
| propylene glycol | | | | | | | | | | 6 | |
| NaOH | 3.2 | | | 2 | 1 | 2.3 | 1.8 | 1.1 | | 1.8 | 4 |
| fluorescent whitening agent Tinopal CBS-x | 0.1 | 0.1 | 0.1 | 0.1 | 0.1 | 0.1 | 0.1 | | | | 0.1 |
| fluorescent whitening agent Tinopal CBS-CL | | | | | | | | 0.1 | 0.1 | 0.1 | |
| Soap | | | | | | | | | | | 7 |
| water to | 100 | 100 | 100 | 100 | 100 | 100 | 100 | 100 | 100 | 100 | |

EXAMPLE 5

Preparation of Different Formulations

| components | formulation 20 | 21 | 22 | 23 | 24 |
|---|---|---|---|---|---|
| combination of 30% of the compound of formula (3) and 70% of propylene glycol | 0.13 | 0.13 | 0.6 | 0.6 | 0.3 |
| o-phenylphenol | 0.2 | 0.2 | 0.9 | 0.9 | 0.45 |
| sodium laureth sulfate | 9.0 | 15 | 1.2 | | |
| cocamidopropyl betaine | 3.0 | 4.5 | 1 | | |
| decyl glucoside | 3.0 | | | | |
| citiric acid | 0.1 | 0.1 | | 3 | |
| polyquaternium-7 | | 0.4 | | | |
| lauramine oxide | | | 1 | | |
| sodium Citrate | | | 4 | | |
| sodium carbonate | | | 3 | | |
| ethanol | | | 3 | | |
| sodium $C_{14-17}$ alkyl sec. sulfonate | | | | 16.6 | |
| sodium laurylsulfate | | | | 20 | |
| Laureth-09 | | | | 3 | |
| sodium cumolsulfonate | | | | 5 | |
| sodium chloride | | | | 3 | |
| Quaternium 18 and iospropylalcohol | | | | | 4 |
| Pareth-25-7 | | | | | 0.5 |
| water to | 100 | 100 | 100 | 100 | 100 |

Formulation 20: shower gel
Formulation 21: shampoo
Formulation 22: all purpose cleaner
Formulation 23: dish washing detergent
Formulation 24: softener detergent

What is claimed is:

1. A surface-active composition comprising (a) from 0.14 to 10% by weight of a mixture of microbicidally active ingredients comprising ($a_1$) from 0.04 to 5% a diphenyl ether compound of formula

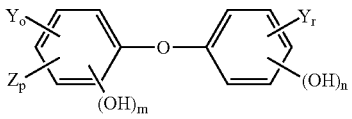

(1a)

wherein

Y is clorine or bromine,

Z is $SO_2H$, $NO_2$ or $C_1$–$C_4$alkyl, r is from 0 to 3, o is from 0 to 3, p is 0.1 or 2, m is 1 or 2 and n is 0 or 1, and ($a_2$ ) from 0.1 to 5% o-phenylphenol, (b) from 0 to 50 % by weight of one or more hydrotropic agents, (c) from 5 to 80 % by weight of one or more synthetic detergents or of a soap or of combinations of the mentioned substances and/or of a salt of a saturated and/or unsaturated $C_8$–$C_{22}$ fatty acid, (d) from 0 to 50 % by weight of an alcohol, (e) from 5 to 50 % by weight of typical ingredients for cleaning and disinfectant compositions and optionally (f) tap water or deionised water ad 100%.

2. A composition according to claim 1, wherein there is used a compound of formula

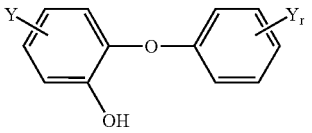

(1b)

wherein

Y is chlorine and r is 1 or 2.

3. A composition according to claim 1, wherein there is used a 2-hydroxy-diphenyl ether of formula

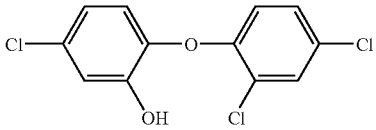

(2)

or

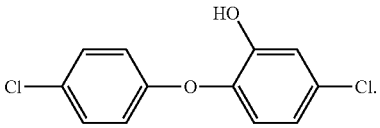

(3)

4. A composition according to claim 1, wherein a sulfonate of a terpenoid or of a mono- or di-nuclear aromatic compound is used as component (b).

5. A composition according to claim 4, wherein the sulfonate of camphor, toluene, xylene, cumene or of naphthol is used as component (b).

6. A composition according to claim 1, wherein a saturated or unsaturated $C_3$–$C_{12}$ di- or poly-carboxylic acid is used as component (b).

7. A composition according to claim 5, wherein a combination of cumenesulfonate and citric acid monohydrate is used as component (b).

8. A composition according to claim 1, wherein a $C_{10}$–$C_{20}$alkylamido-$C_1$–$C_4$alkylenebetaine is used as component(b).

9. A composition according to claim 1, wherein a salt of lauric, myristic, palmitic, stearic, arachidic, behenic, caproleic, dodecenoic, tetradecenoic, octadecenoic, oleic, eicosenoic or erucic acid is used as component (c).

10. A composition according to claim 1, wherein propylene glycol is used as component (d).

11. A composition according to claim 1, wherein ethanol, propanol, isopropanol or a mixture of said alcohols is used as component (d).

12. A method for the antimicrobial treatment of textile fibre materials in a washing liquor, which method comprises treating the textile fibre materials in the washing liquor with the composition of claim 1.

13. A method according to claim 12, wherein the composition is used in powder washing formulations, washing pastes, liquid washing formulations, fabric softeners or solid soaps.

14. A method for imparting antimicrobial properties to textile fibre materials, which method comprises treating the textile fibre materials in a washing liquor with the composition of claim 1, wherein at least a fraction of the antimicrobial active ingredient remains on the textile fibre material.

* * * * *

UNITED STATES PATENT AND TRADEMARK OFFICE

CERTIFICATE OF CORRECTION

PATENT NO. : 7,041,631 B2
APPLICATION NO. : 10/901733
DATED : May 9, 2006
INVENTOR(S) : Dietmar Ochs et al.

It is certified that error appears in the above-identified patent and that said Letters Patent is hereby corrected as shown below:

Title page,

The title should read:

(54) SURFACE-ACTIVE COMPOSITIONS COMPRISING A MIXTURE OF DIPHENYL ETHER AND O-PHENYLPHENOL

Signed and Sealed this

Thirtieth Day of January, 2007

JON W. DUDAS
*Director of the United States Patent and Trademark Office*